US005829216A

United States Patent [19]

Newcomb et al.

[11] Patent Number: 5,829,216

[45] Date of Patent: Nov. 3, 1998

[54] SEISMIC FACADE SUPPORT

[75] Inventors: Stephen L. Newcomb, Moore; Trest Polina, Norman; Dale A. Schmitt, Oklahoma City, all of Okla.

[73] Assignee: Balco/Metalines, Inc., Wichita, Kans.

[21] Appl. No.: 731,757

[22] Filed: Oct. 18, 1996

(Under 37 CFR 1.47)

[51] Int. Cl.[6] ..... E04B 1/684; E04B 2/56

[52] U.S. Cl. ..... 52/395; 52/167.1; 52/396.04; 52/396.05; 52/506.05; 52/506.06

[58] Field of Search ..... 52/395, 396.04, 52/396.05, 506.03, 506.08, 510, 167.1, 506.05, 506.06

[56] References Cited

U.S. PATENT DOCUMENTS

| | | | |
|---|---|---|---|
| 3,270,474 | 9/1966 | Driggers | 52/396.04 X |
| 3,470,662 | 10/1969 | Kellman | 52/396.04 X |
| 3,864,886 | 2/1975 | Thom | 52/396.04 X |
| 5,065,557 | 11/1991 | Laplante et al. | 52/510 X |
| 5,414,971 | 5/1995 | Handte | 52/506.06 |
| 5,644,879 | 7/1997 | Shreiner et al. | 52/393 |

*Primary Examiner*—Christopher Kent
*Assistant Examiner*—Timothy B. Kang
*Attorney, Agent, or Firm*—Hovey, Williams, Timmons & Collins

[57] ABSTRACT

A support for connecting a facade to at least one and preferably two buildings permits limited movement of the facade during seismic disturbances. The support includes a coupler presenting a projecting member and a mount presenting a receiver complementally configured with the projecting member. In one application, the projecting member and receiver define a track for permitting relative translational movement therealong, while in another application the projecting member and receiver define a hinge which may permit both limited pivotal movement and limited translational movement between the projecting member and the receiver. A plurality of tracks oriented in parallel or in perpendicular orientations may be employed to permit movement along different axes, and in particularly preferred embodiments wherein the facade spans the gap between two adjacent buildings, the support permits limited movement of the facade relative to the buildings along three orthogonal axes of translational movement and limited pivoting about three orthogonal axes.

26 Claims, 3 Drawing Sheets

SEISMIC FACADE SUPPORT

BACKGROUND OF THE INVENTION

1. Field of the Invention

This invention broadly concerns a device for supporting building facades where the facade may be subject to movement relative to the supporting structure. More particularly, it is concerned with a device which supports building facades for translational or pivoting movement relative to the supporting building or buildings to withstand seismic stresses.

2. Description of the Prior Art

The use of facades in the construction field has as its purpose the enhancement of the aesthetic appearance of a structure, or possibly the provision of thermal or sound isolation to the interior rather than functioning as a load-bearing member. Facades, as used herein, refers to panels or structures attached to the exterior of a structure or structures, and may be made of stone, masonry, metal, or other materials, or combinations thereof.

In the wake of recent earthquakes in California and elsewhere, architects and engineers are compelled to consider the ability of a structure to withstand small and moderate earthquakes with only minor damage. In many regions lying astride active fault lines, architects and engineers are cognizant of increased concern and new regulations concerning the resistance or accommodation of buildings to seismic activity. However, the concept of enhancing the resistance of building facades to seismic activity is a new one.

SUMMARY OF THE INVENTION

The problem of developing a system for mounting a facade to a building with increased resistance to seismic disturbance is largely solved by the present invention. That is to say, the present invention provides a system which permits a facade to be supported from a building, or between two buildings, in a manner which allows limited movement of the facade relative to the building or buildings, thus reducing stress on the mounting system during earthquakes and the like.

The system of the present invention advantageously includes a support which connects the facade to the building in a manner which permits relative movement therebetween. In many applications, the facade will connect or span a gap between two or more buildings, and must accommodate relative movement between the two buildings. In preferred embodiments, the system may permit both limited translational and pivotal movement, and in particularly preferred embodiments, the movement may be translational in three orthogonal axes and pivotal about the three rotational axes. The capability of permitting translational and pivotal movements minimizes the effect of building movement on the facade and its supports when the building or buildings oscillate in unpredictable patterns as a result of e.g., slip, strike-slip, oblique slip or separation type faults.

The system hereof includes a coupler, a mount complementally configured to the coupler and shiftable interconnected to the coupler, and means for connecting the mount and the coupler respectively to at least one building and a facade. The coupler may be in the form of a track element a projecting member and the mount providing a receiving member complementally configured to the projecting member for permitting relative movement, such as shiftable movement therebetween. In the case of the track and guide element slidably mounted thereon, the shiftable movement is translational. Another type of coupler having a projecting member is a hinge presenting a pin, with the mount presenting a recess for receiving the hinge pin. In the present invention, the hinge hereof is operatively coupled to the facade and a building and configured to permit both limited pivoting and limited translational movement between the coupler and mount.

In particularly preferred embodiments where the facade spans two buildings, multiple tracks may be employed and oriented along either parallel or perpendicular axes. For example, multiple parallel tracks would be employed to provide adequate support for a medium or large facade, while tracks oriented perpendicular thereto would permit movement of the facade along a different orthogonal axis. Moreover, the system may employ link pins to interconnect system components, providing additional pivoting, typically in the range of at least about 6 degrees. In addition, panels of rubber or synthetic resin such as polyvinyl chloride may be employed to provide environmental protection to the components against rain and wind-borne grit, but which will resiliently yield during seismic disturbances to permit relative movement between the facade and supporting buildings. The vinyl strips or panels are placed to permit the facade or system components to move thereagainst and to yield before the metal components of the system are permanently deformed or fail.

The system hereof is particularly useful in buildings which are separated by a gap of two feet, or more commonly four feet or more, and which employ a facade to conceal the separation. Such gaps permit the adjacent buildings to move relative to one another, and the system hereof permits the facade to span the gap and move in relationship to one or both buildings to minimize stress, damage or even separation of the facade.

DESCRIPTION OF THE PREFERRED EMBODIMENT

Figures 2, 3, 6, 7:
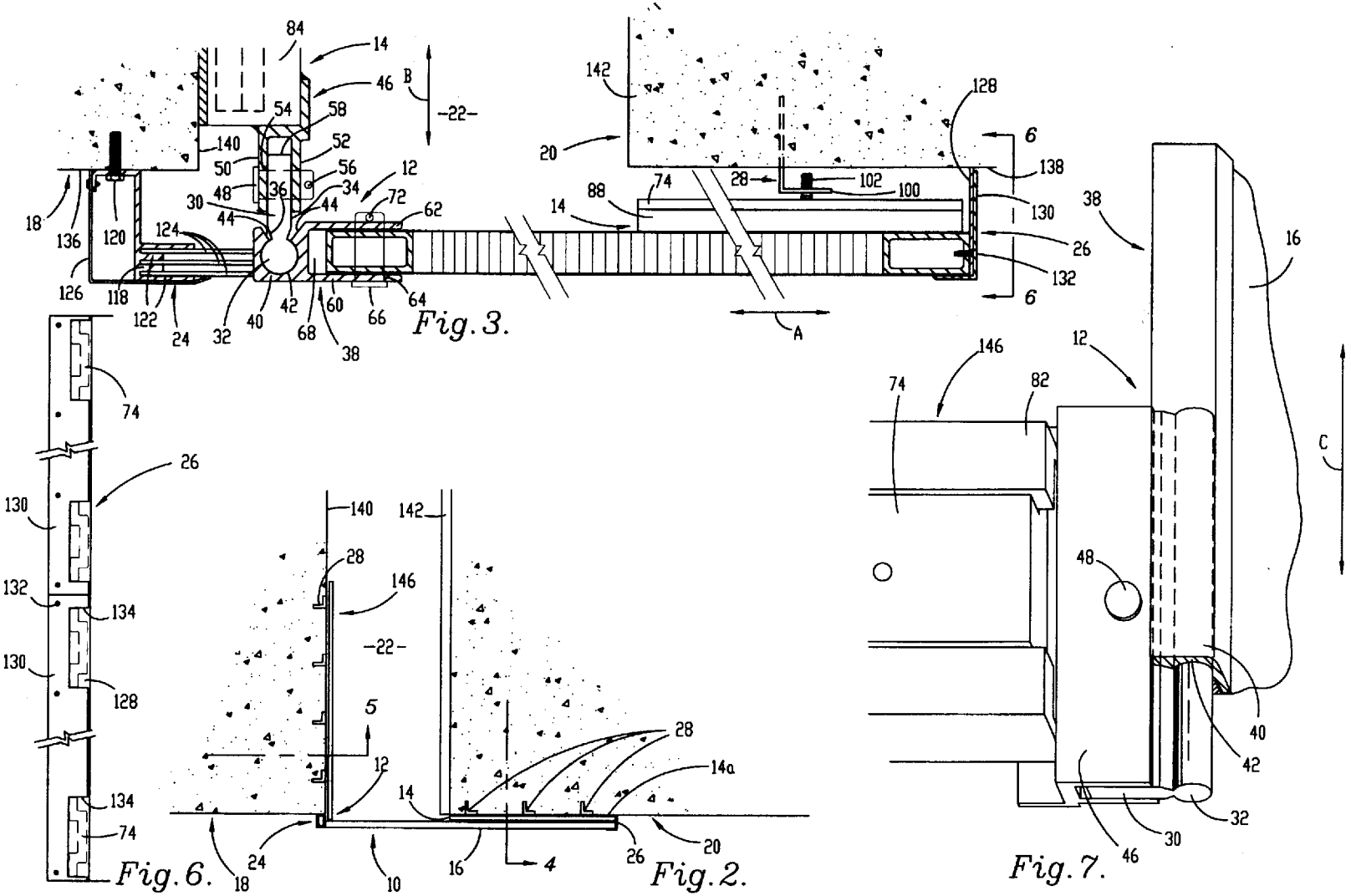
FIG. 2 is a top plan view of the support hereof, showing the buildings and facade and angle irons secured to the building for carrying the support hereof.
FIG. 3 is an enlarged, fragmentary view of the facade support hereof, with one track only partially shown and the facade foreshortened.
FIG. 6 is an end elevational view taken along line 6—6 of FIG. 3 with portions of the track shown in phantom.
FIG. 7 is an enlarged, fragmentary perspective view of the hinge of the support.

Referring now to the drawing, a seismic facade support 10 broadly includes hinge 12 and tracks 14*a* and 14*b* for movably supporting a facade 16 between a first building 18 and a second building 20 as is shown in FIG. 3. While a facade support 10 may be employed to support a facade 16 on only a single building, the use of the support on two adjacent buildings 18 and 20 separated by a gap 22 which is typically in excess of four feet (about 1.25 meters) presents an advantageous use as demonstrated in the figures. The support 10 also preferably includes a seal cap 24 and end cap 26 which are useful both aesthetically and for limiting access of precipitation and grit to the support 10 located behind the facade 10. Angle irons 28 are secured to the buildings 18 and 20, typically by mortar or welding, to carry the support 10 and therefore the facade 16. It may be readily appreciated that beams incorporated in the buildings' structural frame or other structural components are an acceptable alternative to the angle irons 28. The buildings 18 and 20 may be of any suitable construction, and may be specially constructed to meet local building codes or requirements in earthquake-prone areas.

In greater detail, the hinge 12 of the support includes a hinge plate 30 which includes a hinge pin 32 projecting therefrom, the hinge plate 30 serving as a coupler 34. The hinge pin 32 is preferably elongated and circular in cross section, and may be fabricated of a suitable material such as aluminum. The junction 36 between the hinge pin 32 and the flattened portion of the hinge plate 30 is beveled to present a reduced transverse dimension adjacent the hinge pin 32. The hinge 12 also includes a mounting bracket 38 which includes a receiver 40 including an elongated slot 42 complementally configured to receive the hinge pin 32 therein. The receiver 40 includes shoulders 44 which are beveled to greater degree than the junction 36 of the hinge plate 30, whereby the hinge plate 30 is free to shift or pivot through a limited range of motion relative to the mounting bracket 38. Preferably, the difference in the beveling of the hinge plate 30 and the shoulders 44 permits at least a 6° range of pivoting movement. Wheel bearing grease or other suitable lubricant aids in the movement. It may also be appreciated from FIG. 7 that the configuration of the hinge 12 enables the hinge pin 32 to shift or move translationally relative to the receiver 40. That is to say, if the hinge pin 32 is oriented substantially vertically as shown in the drawing, the receiver 40 and thus the facade 16 connected thereto is permitted limited up and down movement relative thereto because of the configuration of the support 10 as set forth herein.

The hinge plate 30 is connected to the track 14*a* by hinge bracket 46 and link 48. The hinge bracket 46 presents a pair of spaced-apart, parallel flanges 50 and 52 which extend on either lateral side of the hinge plate 30. Each of the flanges 50 and 52 include a plurality of circular, opposed and aligned holes 54 for receiving link 48 therethrough and through a corresponding aligned hole in the hinge plate 30. The link 48 is retained in position by an enlarged head portion and a cotter pin 56 as is conventional. As shown in FIG. 3, the hinge plate 30 includes an end wall 58 which is spaced from the opposing surface of the hinge bracket 46 whereby the space therebetween enables the hinge plate limited pivotal movement about an axis defined by the link 48. That portion of the hinge bracket 46 remote from the flanges 50 and 52 is welded or otherwise secured by suitable fasteners to track 14 and thus fixed relative to the track 14 but capable of limited movement relative to mounting bracket 38.

Mounting bracket 38 includes a pair of spaced-apart, opposed arms 60 and 62 each provided with a circular, opposed hole 64. Link 66, similar to link 48, passes through the holes 64 and through corresponding aligned holes in the facade 16 for pivotally supporting facade 16 between the arms 60 and 62. It may be seen that there is a slight clearance 68 between the facade 16 and the wall 70 of the mounting bracket 38 between the arms 60 and 62, which enables the facade 16 to pivot about the link 66 through a limited range similar to the limited pivoting action of the hinge plate 30 and hinge bracket 46. A cotter pin 72 passes through the link 66 opposite its head to hold the link in position.

Tracks 14*a* and 14*b* are similar in enabling translational movement of the facade 16 relative to a building. Tracks 14*a* and 14*b* each include a track element 74 serving as a coupler and presenting opposed, divergent and outwardly projecting rails 76 and 78 and a recessed bight 80, and a guide 82 slidably carried by the track element 74. The guide 82 serves as a mount for carrying the facade 16 in the case of track 14*a*, while in the case of track 14*b*, a modified double guide 84 carries hinge bracket 46, which as explained above, is operatively connected to and functionally mounts the facade 16. The guide 82 and the double guide 84 are complementally configured with the track element 74 to be slidingly carried thereon and include a central wall 86 connecting opposed legs 88 and 90 presenting inwardly oriented convergent feet 92 and 94 respectively to define therein a receiving area 96. As may be seen from FIG. 1, a plurality of tracks 14*a* or 14*b* may be mounted in parallel to provide sufficient support for a facade of the size and weight selected. Additionally, it may be appreciated that the tracks 14 may be oriented at angles to one another to provide translational movement along different axes, such as the perpendicular orientation between the tracks 14*a* and 14*b* as shown in FIG. 2.

Figure 1:
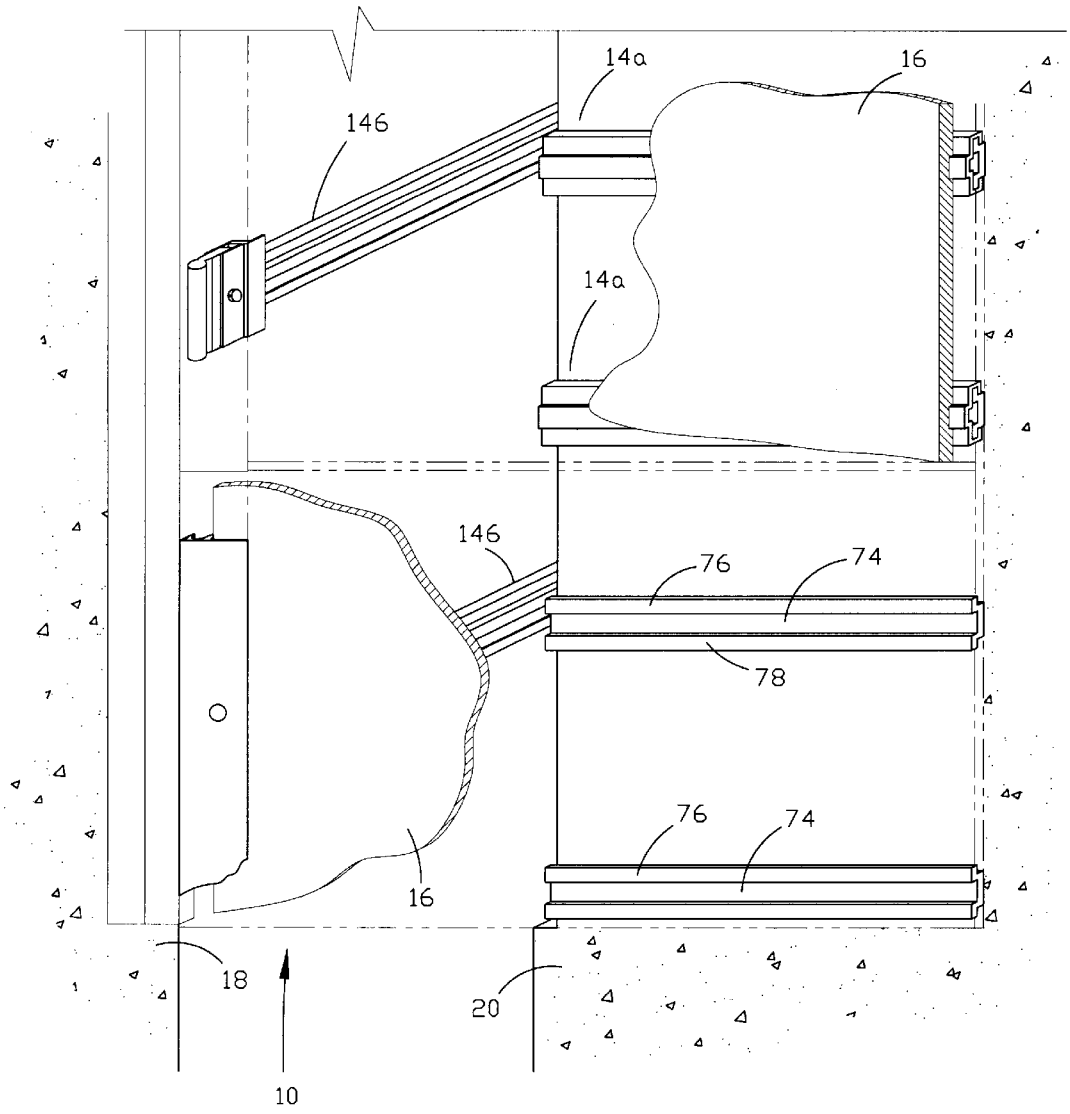
FIG. 1 is a front perspective view of the facade support hereof spanning a gap between two adjacent buildings, with portions of the facade and part of the support removed for clarity.

The track elements 74 are preferably positioned with their longitudinal axes substantially horizontal as shown in FIG. 1, although other orientations are entirely within the scope of the teachings hereof. However, horizontal orientations serve the dual purpose of supporting the facade and permitting translational movement without the necessity of further load bearing supports. To facilitate relative translational movement between the track elements 74 and guide 82 or double guide 84, a friction-resistant strip 98 of polytetrafluoroethylene, commonly sold under the trademark TEFLON, or other suitable synthetic resin material may be employed.

Angle irons 28 or other suitable mounting brackets are secured to the building 18 or 20 so as to present an upright, preferably planar, fixed mounting surface 100 for receiving the track element 74 thereon. Track elements 74 are fixed to the surface by a mounting pin 102 which is preferably threaded into surface 100, or alternatively may be welded thereto or embedded in the building structure. Pin 102 preferably passes through a central bore 104 in the bight 80 and the head of the pin 102 and a suitable washer restrain the track elements 74 against outward movement relative to the building. The track elements 74 preferably are slightly spaced away from the surface 100 and leveled so that the rails 76 and 78 lay in an upright plane by leveling bolts 106 and 108 which are threadably held in respective apertures 110 and 112 extending through the vertically disposed rails and bight 80. The leveling bolts 106 and 108 are screwed into apertures 110 and 112 until they engage surface 100 and the track elements 74 are properly aligned and oriented. In the case of track 14*a*, the guide 82 is preferably secured to the facade 16 by machine screws 114 and 116, while in the embodiment shown herein, double guide 84 of track 14*b* is welded to mounting bracket 38 as shown in FIG. 3.

The hinge 12 and the track 14 are preferably covered at the ends of the facade 16 by seal cap 24 and end cap 26. Seal cap 24 includes a bracket 118 which is preferably threadably mounted to the building 18 by bolt 120. The bracket 118 includes fingers 122 defining slots therebetween for carrying resilient and yieldable vinyl seal strips 124 or alternatively a seal with integrally formed strips 124 may be substituted. Seal strips 124 extend between bracket 118 to engage receiver 40 but are sufficiently flexible to yield responsive to movement of the receiver 40 and facade 16. In this connection, the ends of the strips 124 engaging the receiver 40 may be bent to more readily yield to movement of the facade 16. A corner flashing 126 is fastened to bracket 118 for purposes of appearance but does not engage receiver 40 and thus does not interfere with translational or other movement of the facade 16.

End cap 26 is positioned opposite seal cap 24 to enclose the remote end of the facade 16. The end cap 26 includes a resilient vinyl panel 128 and a cover flashing 130. The vinyl panel 128 extends between the building 20 and the facade 16 to engage both and partially enclose the area between the facade 16 and the building and preferably is oriented vertically as shown in FIGS. 3 and 6. The cover flashing 130 is fastened to the facade 16 by screws 132 or other suitable fasteners and is provided with notches 134 as shown in FIG. 6 in alignment with the tracks 14*a*, and more particularly the track elements 74. In the event of a seismic event, the panel 128 is sufficiently yieldable and resilient so as to permit the facade 16 to move along the tracks 14 and the track elements to distend or enlarge the panel 128 without permanent damage unless the seismic event is particularly violent. Thus, the panel 128 is permitted to yield and deform rather than forcing the corner flashing 130 to absorb the forces resulting from movement of facade 16 along track 14*a* relative to building 20.

It is to be understood that the facade 16 may be of any conventional construction, so that metal, masonry, wood or other building materials may be used in its construction without substantial effect on the operability of the present invention. Similarly, buildings 18 and 20, while preferably of modern, earthquake-resistant design and materials, may be of any suitable construction for supporting the weight load of the facade. Buildings 18 and 20 each have respective front walls 136 and 138 which are preferably though not necessarily in substantial alignment, and further present side walls 140 and 142 which are preferably upright, opposed and substantially parallel. However, it may be understood that the invention hereof is uniquely adaptable to accommodate mounting of the facade to walls which are not so configured. In order to accommodate movement of the buildings 18 and 20 during seismic events, the gap 22 therebetween is preferably at least 48 inches, although smaller dimensions of gap 22 can readily be accommodated by the support hereof.

Figure 5:
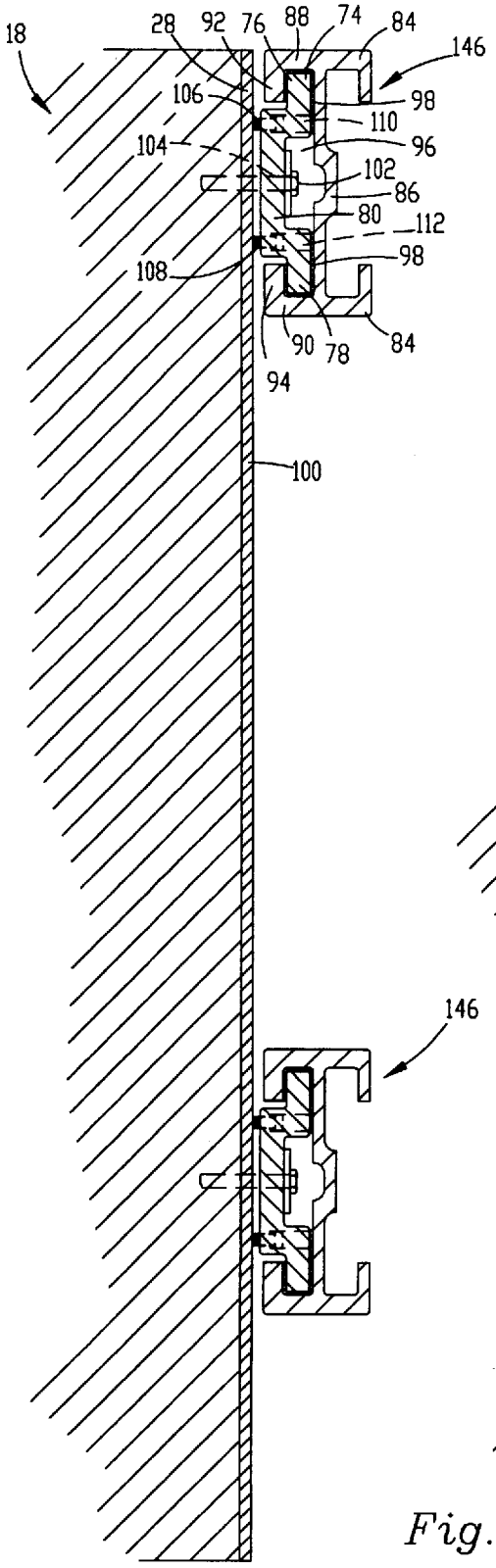
FIG. 5 is a vertical cross-sectional view of the facade support taken along line 5—5 of FIG. 2 to illustrate the second track portion of the support oriented perpendicular and along a second building respective to the track of FIG. 4.
Figure 4:
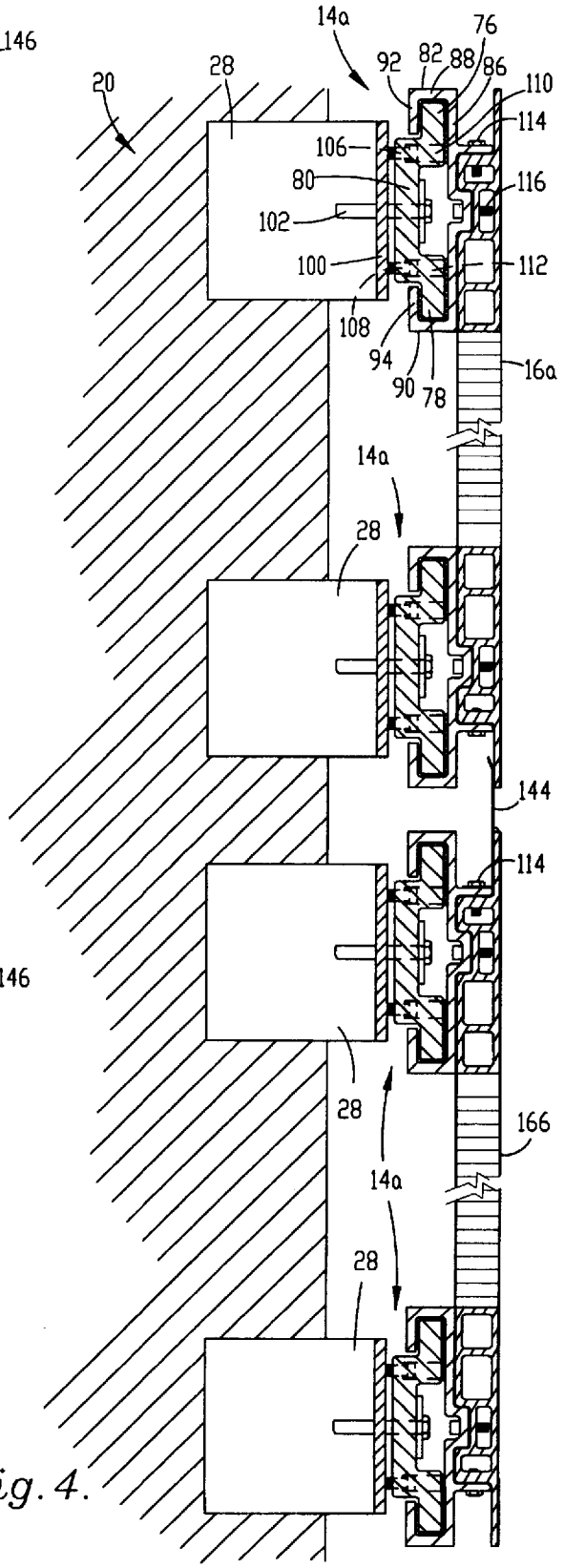
FIG. 4 is a vertical cross-sectional view of the facade support taken along line 4—4 of FIG. 2 to illustrate the facade and a track portion of the support.

In use, the tracks 14*a* and 14*b* are attached to angle irons 28 by the threaded pins 102 as shown in FIGS. 4 and 5. As may be seen in FIG. 4, when the facade 16 is provided in multiple sections 16*a* and 16*b*, a lip 144 may be fastened by screws 114 to one of the adjacent facades, in this case 16*b*, and then extend across the lower margin of the upper facade 16*a* to serve as a weather strip and provide a somewhat continuous appearance. After the tracks 14 are in place, leveling bolts 106 are adjusted to properly orient the track elements 74 relative to the respective building 18 or 20. Hinge bracket 46, which may have been pre-attached to double guide 84 by welding or other fastening means, is coupled to hinge plate 30 by link 48.

Thereafter, the respective guides 82 are attached to the facade by machine screws 114 and 116 as shown in FIG. 4, and double guide 84, carrying hinge bracket 46 is slidably coupled to track element 74 of track 14*b*. The facade 16, now carrying the guide 82, is mounted to the track element 74 of track 14*a* by sliding the guides 82 onto track element 74 until the facade is properly positioned relative to walls 136 and 138. Mounting bracket 38 is then coupled to hinge plate 30 by aligning the slot 42 with hinge pin 32 until vertically aligned with the hole 64 of mounting bracket 38 aligned with corresponding holes in the facade 16. Link 66 is then inserted through the hole 64 and the corresponding holes in the facade 16 for coupling the facade 16 to the hinge plate 30 and therefore the track 14*b*. Thereafter, seal cap 24 and end cap 26 are fastened to the building 18 and facade 16 respectively and as described above.

It may be appreciated that so mounted, in the event of an earthquake or other seismic event, the facade is permitted limited movement relative to buildings 18 and 20. In this connection, the configuration hereof permits limited translational movement of the facade 16 along track 14*a* along a first translational axis A as shown in FIG. 3. At the same time, track 14*b* permits limited translational movement of the facade 16 normal to its plane along axis B. Finally, as may be evident from viewing FIG. 7, the receiver 40 is permitted to move a limited distance along hinge pin 32 and thus along a third translational movement axis C. It may be appreciated that axes A, B and C lie along three orthogonal axes.

Further, the relative separation between shoulders 44 and junction 36 of the hinge plate permits the receiver 40 and thus the facade 16 coupled thereto to pivot about an axis parallel to axis C through a preferable range of at least about 6°. Link 48 pivotally couples hinge plate 30 to hinge bracket 46 for limited pivotal movement of the hinge plate 30 and thus the facade 16 relative to the hinge bracket 46 and thus the building 18 to which it is attached. Link 48 thus defines a pivot axis which is substantially parallel, though not necessarily so to axis A. The limitation on pivoting is provided by the limited space between end wall 58 and the hinge bracket 46, so that excessive pivoting is inhibited upon engagement of the end wall 58 and the hinge bracket 46. Link 66 similarly pivotally couples facade 16 to hinge plate 30 and thus building 18. Link 66 defines a pivot axis which is preferably, though not necessarily, substantially parallel to translational axis B. Again, the amount of pivoting about link 66 is limited by the relatively small clearance 68 between the end of facade 16 and the receiver 40 of mounting bracket 38, so that only limited pivoting is permitted in the manner previously described between the hinge plate 30 and the hinge bracket 46. From the foregoing, it may be appreciated that hinge pin 32, link 48 and link 66 define three respective orthogonal pivot axes preferably substantially parallel to translational axes A, B and C.

In the event of a seismic disturbance such as an earthquake causing relative movement between buildings 18 and 20, facade 16 is permitted limited independent shifting, thereby restricting stress on the threaded pins 102 holding the track elements 74 to the respective buildings. For example, if building 18 oscillates along axis B while building 20 moves back and forth along axis A, the facade 16 is permitted limited movement along tracks 14*a* and 14*b* to accommodate relative movement. This is further enhanced by the ability of the facade 16 to pivot about hinge pin 32, so that stresses do not build up internally within the facade 16. The use of friction resistant strips 98 serves to further lessen the build-up of stress within facade 16 and to lessen the likelihood that the guides 82 and the double guides 84 will seize relative to track elements 74 during periods of seismic activity. By permitting limited movement about three orthogonal pivot axes and limited translational movement along three axes, the facade support 10 hereof is able to accommodate independent movement between two adjacent buildings 18 and 20, even when the movement of the buildings is independent, including relative vertical movement between the buildings. By employing seal cap 24 and end cap 26 as described herein many routine seismic events may be accommodated without structural or aesthetic damage either to the facade 16 or to the support 10.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the liberal scope of the invention as set out in the following claims.

It is claimed:

1. A support for a facade for coupling the facade to a supporting building and for permitting relative movement between the facade and the supporting building, said support comprising:

a coupler presenting a projecting member;

a mount presenting a receiving member complementally configured to said projecting member for permitting relative movement between said projecting member and said receiving member;

first means adapted for operatively connecting one of said coupler and said mount to the facade; and second means adapted for operatively connecting the other of said coupler and said mount to the building, wherein said projecting member defines a pivot axis for relative shiftable movement between the projecting member and the receiving member, further including a first link pin connecting said projecting member to one of said first and second connecting means.

2. A support for a facade as set forth in claim 1, wherein said receiving member is slidably coupled to said projecting member.

3. A support for a facade as set forth in claim 2, wherein said projecting member presents an elongated track element for receiving said receiving member slidably therein.

4. A support for a facade as set forth in claim 3, including means for adjusting the orientation of the elongated track element.

5. A support for a facade as set forth in claim 3, including an insert of friction-resistant synthetic resin material disposed between said coupler and said mount.

6. A support for a facade as set forth in claim 3, including a plurality of corresponding pairs of couplers and mounts, at least some of said couplers presenting longitudinal tracks in substantially parallel orientation.

7. A support for a facade as set forth in claim 1, wherein said first link pin is oriented along a first link axis substantially normal to said pivot axis.

8. A support for a facade as set forth in claim 7, including a second link pin connecting said receiving member to the other of said first and second connecting means.

9. A support for a facade as set forth in claim 8, wherein said second link pin is oriented along a second link axis substantially normal to said pivot axis and normal to said first link axis.

10. A support for a facade as set forth in claim 1, wherein said second connecting means includes a longitudinal track and a slide element for permitting longitudinal sliding movement of at least one of said projecting member and said receiving member relative to the building.

11. A support for a facade as set forth in claim 1, wherein said projecting member presents a hinge pin.

12. A support for a facade for coupling the facade to a supporting building and for permitting relative movement between the facade and the supporting building, said support comprising:

a coupler presenting a projecting member;

a mount presenting a receiving member complementally configured to said projecting member for permitting relative movement between said projecting member and said receiving member;

first means adapted for operatively connecting one of said coupler and said mount to the facade; and second means adapted for operatively connecting the other of said coupler and said mount to the building, wherein said receiving member is slidably coupled to said projecting member, wherein said projecting member presents an elongated track element for receiving said receiving member slidably therein, further including means for adjusting the orientation of said elongated track element, wherein said mount includes a plate member substantially fixed relative to said building and said adjusting means includes at least one leveling bolt threadably secured to one of said longitudinal track and said plate member for abutting the other of said longitudinal track and plate member.

13. A support for a facade for coupling the facade to a supporting building and for permitting relative movement between the facade and the supporting building, said support comprising:

a coupler presenting a projecting member;

a mount presenting a receiving member complementally configured to said projecting member for permitting relative movement between said projecting member and said receiving member;

first means adapted for operatively connecting one of said coupler and said mount to the facade; and second means adapted for operatively connecting the other of said coupler and said mount to the building, wherein said receiving member is slidably coupled to said projecting member, wherein said projecting member presents an elongated track element for receiving said receiving member slidably therein, further including a plurality of corresponding pairs of couplers and mounts, at least some of said couplers presenting longitudinal tracks oriented substantially nonparallel to the longitudinal tracks of other of said mounts.

14. In combination:

a first building presenting a first forward wall and a first side wall;

a second building presenting a second forward wall and a second side wall, said first side wall being opposed to and spaced from said second side wall to present a gap therebetween;

a facade; and a support for connecting said facade to said first building and to said second building to substantially overlie said gap, said support including connecting means for permitting relative movement of said facade to at least one of said first and second buildings, said connecting support including a first longitudinal track element coupled to one of said first and second buildings and a first guide element slidably mounted to said first track element and operatively coupled to said facade for permitting relative sliding movement between said facade and said one of said buildings.

15. The combination of claim 14, said connecting support including means for permitting relative movement between said facade and both of said first and second buildings.

16. The combination of claim 14, said connecting support including a second longitudinal track element coupled to the other of said first and second buildings and a second guide element slidably mounted to said second track element and operatively coupled to said facade for permitting relative sliding movement between said facade and both of said buildings.

17. The combination of claim 16, wherein said first track element and said second track element are substantially nonparallel.

18. The combination of claim 14, wherein said first side wall and said second side wall are separated by a gap of at least about 48 inches.

19. The combination of claim 14, wherein said connecting support permits limited translational movement of said facade relative to at least one said first and second buildings along three orthogonal axes and limited pivotal movement between said facade and at least one of said first and second buildings about each of said three orthogonal axes.

20. In combination:

a first building presenting a first forward wall and a first side wall;

a second building presenting a second forward wall and a second side wall, said first side wall being opposed to and spaced from said second side wall to present a gap therebetween;

a facade; and a support for connecting said facade to said first building and to said second building to substantially overlie said gap, said support including connecting means for permitting relative movement of said facade to at least one of said first and second buildings, wherein said connecting support includes a hinge pin operatively connected to one of either of said first or second buildings and said facade and a receiver complementally configured to said hinge pin and mounted thereon, said receiver being operatively connected to the other of said first or second buildings and said facade for permitting limited pivoting movement of said facade relative to one of said first or second buildings.

21. The combination of claim 20, wherein said connecting support includes a first link pin operatively connecting said hinge pin to one of said first or second buildings and said facade for permitting limited pivoting movement of said hinge pin relative to one of said first or second buildings and said facade.

22. The combination of claim 21, wherein said connecting support includes a second link pin operatively connecting said receiver to one of said first or second buildings and said facade for permitting limited pivoting movement of said receiver relative to one of said first or second buildings and said facade.

23. In combination:

a first building presenting a first forward wall and a first side wall;

a second building presenting a second forward wall and a second side wall, said first side wall being opposed to and spaced from said second side wall to present a gap therebetween;

a facade;

a first track operatively interconnecting said facade and said first building including a first track element connected to said first building and a first guide element shiftably carried thereon;

a second track operatively interconnecting said facade and said second building including a second track element connected to said second building and a second guide element shiftably carried thereon, said second guide element being oriented for movement along said second track element in a direction substantially normal to the direction of movement of said first guide element; and means swingably mounting said facade to one of said first and second tracks for movement of said facade relative to one of said first and second buildings about an upright axis, said swingable mounting means including a hinge pin operatively coupled to said first track;

a receiver complementally configured to receive said hinge pin therein and operatively coupled to said second track.

24. The combination as set forth in claim 6, wherein said receiver is slidably coupled to said hinge pin for permitting limited longitudinal movement therebetween along said upright axis.

25. The combination of claim 6, including a link pin connecting said hinge pin to said first track for permitting limited pivotal movement therebetween.

26. The combination of claim 6, including a link pin connecting said receiver to said second track for permitting limited pivotal movement therebetween.

* * * * *